US008104314B2

(12) United States Patent
Mueller et al.

(10) Patent No.: US 8,104,314 B2
(45) Date of Patent: Jan. 31, 2012

(54) DEVICE FOR ACTUATING THE LOCK IN THE DOOR OR FLAP OF A VEHICLE

(75) Inventors: Dirk Mueller, Essen (DE); Stefan Moenig, Schwelm (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 429 days.

(21) Appl. No.: 12/310,452

(22) PCT Filed: Jul. 25, 2007

(86) PCT No.: PCT/EP2007/006595

§ 371 (c)(1),
(2), (4) Date: Feb. 25, 2009

(87) PCT Pub. No.: WO2008/025418

PCT Pub. Date: Mar. 6, 2008

(65) Prior Publication Data

US 2010/0000272 A1 Jan. 7, 2010

(30) Foreign Application Priority Data

Aug. 26, 2006 (DE) ..... 10 2006 040 139

(51) Int. Cl.
*E05B 9/08* (2006.01)

(52) U.S. Cl. ..... 70/370; 70/451; 70/452; 70/208

(58) Field of Classification Search ..... 70/370, 70/451, 452, 208, 210
See application file for complete search history.

(56) References Cited

U.S. PATENT DOCUMENTS

| | | | | |
|---|---|---|---|---|
| 1,832,362 | A * | 11/1931 | Cullinan | 137/384.2 |
| 2,724,958 | A * | 11/1955 | Psik | 70/181 |
| 3,358,483 | A * | 12/1967 | Wellekens | 70/370 |
| 3,899,907 | A | 8/1975 | Prahl | |
| 5,224,364 | A * | 7/1993 | Claar et al. | 70/237 |
| 5,987,942 | A * | 11/1999 | Ichinose | 70/208 |
| 5,987,943 | A * | 11/1999 | Verga et al. | 70/208 |
| 6,494,066 | B2 * | 12/2002 | Muneta | 70/208 |
| 6,550,295 | B2 * | 4/2003 | Hubner | 70/208 |
| 6,604,393 | B2 * | 8/2003 | Larsen et al. | 70/208 |
| 6,843,085 | B2 * | 1/2005 | Dimig | 70/237 |
| 7,146,832 | B2 * | 12/2006 | Mathofer | 70/208 |
| 7,302,819 | B2 * | 12/2007 | Lennhoff | 70/371 |
| 7,387,004 | B2 * | 6/2008 | Schutz et al. | 70/215 |
| 7,444,845 | B2 * | 11/2008 | Kargilis et al. | 70/370 |
| 7,603,881 | B2 * | 10/2009 | Yukihara et al. | 70/208 |

(Continued)

FOREIGN PATENT DOCUMENTS

CN 2143648 10/1993

(Continued)

*Primary Examiner* — Suzanne Barrett
(74) *Attorney, Agent, or Firm* — Lucas & Mercanti, LLP; Klaus P. Stoffel

(57) ABSTRACT

A construction unit (35) comprising a support (30) and a locking cylinder (20) is present in the device and is secured from the inner door side (11) behind the outer door lining (15). Those parts of the locking cylinder which project on the outer door side are covered by a cap which is secured on the inner door side (11) by securing means. In order to simplify the handling and to save space, it is proposed to use the securing means for the cap at the same time in order to also secure the construction unit (35) on the inner door side (11).

15 Claims, 2 Drawing Sheets

U.S. PATENT DOCUMENTS

| | | | | |
|---|---|---|---|---|
| 7,854,153 | B2 * | 12/2010 | Lennhoff et al. | 70/370 |
| 2002/0124606 | A1 | 9/2002 | Muneta | |
| 2002/0124607 | A1 * | 9/2002 | Hubner | 70/208 |
| 2003/0010073 | A1 * | 1/2003 | Larsen et al. | 70/208 |
| 2004/0129040 | A1 * | 7/2004 | Mathofer et al. | 70/208 |
| 2007/0186598 | A1 * | 8/2007 | Najima | 70/208 |
| 2008/0127690 | A1 * | 6/2008 | Zagoroff | 70/208 |
| 2008/0185850 | A1 * | 8/2008 | Takaya et al. | 292/336.3 |

FOREIGN PATENT DOCUMENTS

| | | |
|---|---|---|
| DE | 200 16 108 | 2/2001 |
| DE | 103 53 977 | 5/2005 |
| EP | 1 333 134 | 8/2003 |
| GB | 2 415 743 | 1/2006 |
| JP | 2001/323690 | 11/2001 |

* cited by examiner

DEVICE FOR ACTUATING THE LOCK IN THE DOOR OR FLAP OF A VEHICLE

The invention concerns a device of the type specified in the introductory clause of claim 1. The device comprises a lock cylinder, which is seated in a support and can be turned by a specific key to operate a lock connected with it. In this regard, the lock cylinder and the support together constitute a preassembled assembly that is mounted as a whole unit from the inside of the door. The parts of the lock cylinder that project out on the outside of the door are covered by a cap, which is fastened on the support by means of a fastening device that is likewise to be handled from the inside of the door.

A device of this type is disclosed by GB 1 415 743 A. In this device, there is a first fastening device, which can be handled from the inside of the door in order to screw the cap located on the outside of the door onto the support. However, there are also two additional fastening devices, by means of which two superimposed components of a lock cylinder are joined with the support to form an assembly. When these additional fastening devices are handled, they are moved in the opposite direction from the direction of the mounting of the cap. Multiple spaces must be provided for the arrangement and handling of these multiple fastening devices. This requires a large amount of space and is complicated.

DE 103 53 977 A1 discloses another device, in which the cap is mounted on a support by means of a bolt to be manipulated from the inside of the door. However, the support and the lock cylinder are not an assembled unit in this case.

DE 200 16 108 U1 describes a device in which a lock cylinder is inserted from the outside of the door through a hole in the door exterior cladding into a drill hole of the support, and then the part of the lock cylinder that projects on the outside of the door is covered by a cap. The cap is anchored through a hole in the support by means of a bolt in a threaded hole of the lock cylinder. Here again, the support and the lock cylinder do not constitute an assembled unit that could be mounted as a whole unit from the inside of the door, but rather the three parts are not joined with one another until the last phase of their installation. This handling operation is also complicated.

The objective of the invention is to develop a reliable device of the type specified in the introductory clause of claim 1, which has an inexpensive design and is distinguished by simple handling. In accordance with the invention, this objective is achieved by the measures specified in claim 1, which have the following special significance.

In the invention, the fastening device has a dual function. First of all, it serves to mount the cap on the support. The same fastening device then has the job of holding the preassembled assembly on the inside of the door. Although the assembly comes from the inside of the door, and the cap is mounted on the outside of the door, they are fastened to each other by a common fastening device. There is thus only a single fastening device to be handled now in order to place both the assembly and the cap in the proper place on the door. In accordance with the invention, a threaded bolt with a shaft and a head is used as the fastening device. In this regard, the bolt shaft enters holes that are aligned with one another in the support, in the lock cylinder, and in the cap.

It is advisable to provide the lock cylinder with a projecting flange, on which the fastening device can act. In this case, the bolt shaft enters holes that are aligned with one another in the support, the flange, and the cap. Other measures and advantages of the invention are specified in the dependent claims and in the following description of two specific embodiments of the invention.

Figure 1:
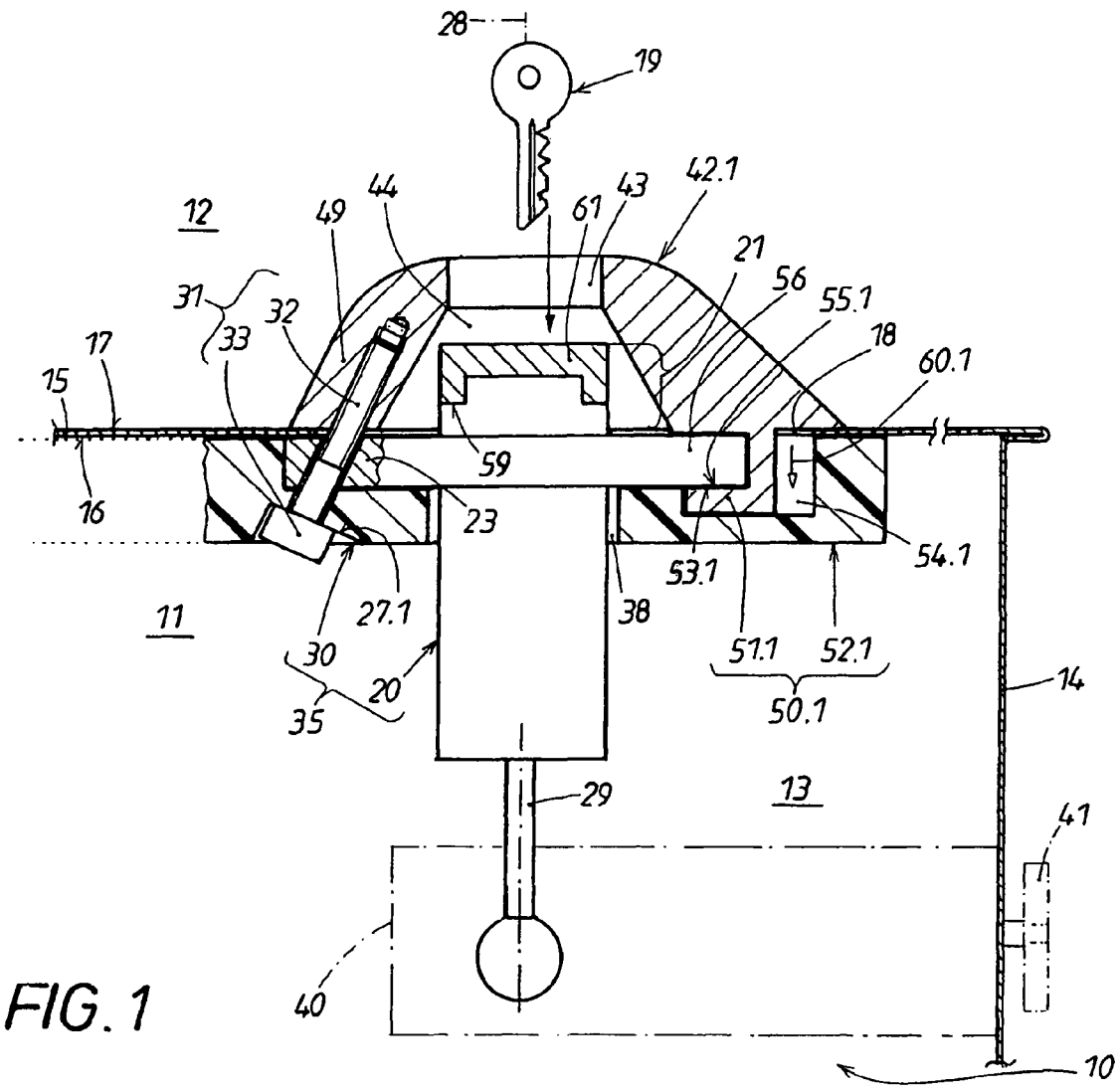
FIG. 1 is a schematic longitudinal section of a portion of a door on which a first embodiment of the device of the invention is mounted.

FIG. 1 shows one basic design of the device of the invention on a door 10. A support 30, which is preassembled with a lock cylinder 20, is located in the interior 13 of the door 10. The support 30 and lock cylinder 20 form an assembly 35 that is handled as a whole. The support 30 has an opening 38, in which the lock cylinder 20 is seated. The joining means between the support 30 and the lock cylinder 20 are not shown. This assembly 35 is mounted from the inside 11 of the door 10 behind a door exterior cladding 15. In this regard, the lock cylinder 20 has parts 21 that project from the outside 12 of the door and/or are accessible from the outside 12 of the door.

When mounted, the lock cylinder 20 is joined with a lock 40, which is indicated in FIG. 1 only as a dot-dash line. The lock 40 has a lock element 41 that projects from the narrow side 14 of the door. The lock element 41 has the function of keeping the door 10 closed or releasing the door for opening. The latter function is normally effected by a door handle (not shown) that acts on the lock 40.

An important function of the lock cylinder 20 is to move the lock 40 between an active position and in inactive position. This is accomplished by means of a key 19 assigned to the lock 40. The key 19 can be inserted from the outside 12 of the door into the lock cylinder 20 of the mounted assembly 35 and turned. A so-called paddle 29, which transmits the rotation of a cylinder core (not shown in FIG. 1) by the key 19 to lock parts in the lock 40, serves as the connecting means between the lock cylinder 20 and the lock 40. Rotation of the inserted key 19 also causes rotation of the paddle 29, thereby moving the lock parts between an active position and an inactive position.

A cap 42.1, which is mounted from the outside 12 of the door, is located on the visible side 17 of the exterior cladding 15 of the door. The cap 42.1 has an axial opening 43 to provide the key 19 access to the lock cylinder 20. The cap 42.1 is aligned with the lock cylinder 20 and covers the parts 21 of the lock cylinder 20 that project from the outside 12 of the door 10 and lie in the interior 44 of the cap 42.1.

A fastening device 31 for the cap 42.1 is provided, which can be manipulated basically only from the inside 11 of the door. This fastening device consists of a bolt 31 that comprises a bolt shaft 32 and a bolt head 33. The manner in which the cap 42.1 is fastened will be explained with reference to FIG. 2, which shows the second specific embodiment. Although the cap 42.2 in FIG. 2 has a design that is modified from that of the cap 42.1 in FIG. 1, the manner in which the cap 42.1, 42.2 is mounted is the same in both cases.

Figure 2:
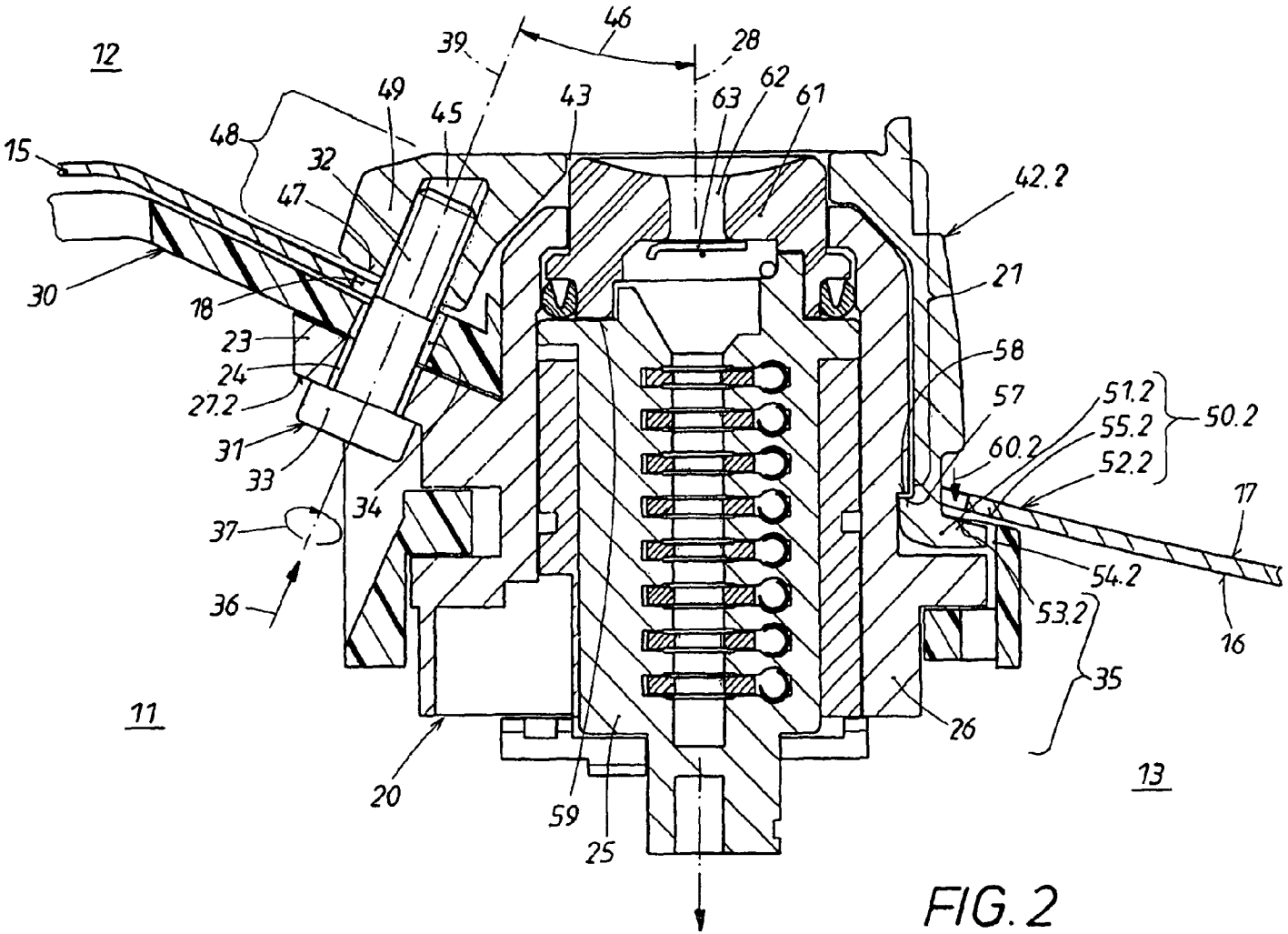
FIG. 2 is a longitudinal section, analogous to FIG. 1, through an alternative embodiment of the device of the invention, from which further details are evident.

According to FIG. 2, the lock cylinder 20 is provided with a lateral flange 23, which covers a portion of the support 30 of the assembly 35. Both the flange 23 and the support 30 are provided with a hole 24 and 34, respectively, through which the bolt shaft 32 can be inserted in the direction of the arrow 36. During its insertion 36, the bolt shaft 32 also passes through the aforementioned opening 18 in the door covering 15 and enters a threaded hole 55 in the cap 42.2. The operation of the bolt 31 illustrated by the rotational arrow 37 is effected on the bolt head 33 and is carried out, as has already been noted, only from the inside 11 of the door. The course of a bolt axis 39 of the bolt shaft 32 in the mounted state is illustrated in FIG. 2 by a dot-dash line. The drawing shows that the bolt axis 39 runs at an angle of inclination 46 to the axis 28 of the lock cylinder 20.

The threaded hole 45 is a blind hole in the cap 42.2. This blind hole starts from an inner end face 47 of a sidewall 48 of the cap 42.2. The sidewall 48 is inclined in a direction that is determined by the aforementioned bolt axis 39. In this connection, the bolt head 33 rests against a support surface 27.2, which, in the case of the cap 42.2 of FIG. 2, is located on the flange 23 of the lock cylinder 20.

The cap 42.1 of the first embodiment in FIG. 1 is mounted in similar fashion. A difference that should be noted is that the order of the lock cylinder flange 23, on the one hand, and the support 30, on the other hand, is reversed in the two cases. Thus, the bolt head 33 in FIG. 1 rests against a support surface 37.1 [sic —27.1] that is located on the support 30.

FIG. 2 shows additional details of the lock cylinder 20, which, of course, are also similarly provided in the specific embodiment of FIG. 1. Naturally, these include a cylinder core 25 with tumblers located inside it, which are sorted by the inserted key and, when this is successfully accomplished, allow the cylinder core 25 to rotate. The cylinder core 25 and its associated cylinder sleeve are arranged in a cylinder housing 26, with which the lock cylinder 20 is preassembled in the support 30.

In both embodiments, coupling means 50.1 and 50.2 are located on the cap 42.1 and 42.2, respectively, on the diametrically opposite side from the point of application 49 of the threaded bolts 31 described above. These coupling means 50.1, 50.2 provide for additional connection between the cap 42.1 and 42.2 and the associated assembly 35. The coupling means 50.1, 50.2 themselves have different designs in the two different embodiments and will be described separately below. The joining together of each of the coupling means 50.1 and 50.2 involves a fixing movement that comprises several phases, the first of which is an insertion phase illustrated by arrows 60.1 and 60.2 in FIGS. 1 and 2, respectively.

The coupling means 50.1 of FIG. 1 comprise a first, moving coupling part 51.1, which is part of the cap 42.1 that is to be mounted. Associated with this first coupling part 51.1 is a second, stationary mating coupling part 52.1, which is part of the assembly 35. The first coupling part 51.1 has a hook-shaped design with a shoulder 53.1 at the end of the hook. After completion of the fixing movement, whose second phase consists in sliding the hook-shaped coupling part 51.1 in a coupling receptacle 54.1, the shoulder 53.1 fits under a mating shoulder 55.1, which in this case is part of an additional radial flange 56 of the lock cylinder 20. The coupling receptacle 54.1 is embedded in the support 30. The coupling receptacle 54.1, the additional radial flange 56 and its mating shoulder 55.1 are parts of the aforementioned second mating coupling part 52.1.

Although the fixing movement between the cap 42.1 and the assembly 35 mounted on the inside 11 of the door is carried out on the outside 12 of the door, this fixing movement has the effect in the interior 13 of the door that the hook-shaped first coupling part 51.1 is pushed in through the aforementioned opening 18 in the exterior cladding 15 of the door in the direction indicated by the insertion arrow 60.1. The hook of this coupling part 51.1 is oriented radially inward towards the axis 28 of the lock cylinder 20. The last phase of the fixing movement is then carried out on the inside of the door in the coupling receptacle 54.1.

The coupling means 50.2 of the second embodiment of the invention, which is shown in FIG. 2, are similar in design, so that the preceding description of the first embodiment of the invention also largely applies to the second embodiment. It is merely necessary to describe the differences in FIG. 2.

The first coupling part 51.2 located on the cap 42.2 also has a hook shape, but in this case the hook is directed radially outward. The insertion phase of the fixing movement illustrated by the arrow 60.2 in FIG. 2 requires a tilted position of the cap, so that the shoulder 53.2 of the hook end can enter the analogous coupling receptacle 54.2 located on the inside 11 of the door. After completion of the fixing movement, the shoulder 53.2 fits behind a mating shoulder 55.2. The second phase of the fixing movement comprises tilting the cap 42.2 back over the lock cylinder parts 21, which in this case as well are located on the outside 12 of the door. In the present case, the mating shoulder 55.2 is formed by a section of the rear side 16 of the exterior cladding 15 of the door that is located in the vicinity of the coupling means 50.2.

In the second embodiment of FIG. 2, the cap 42.2 additionally has a radially inwardly directed axial shoulder 57, which contacts a mating shoulder 58 in the lock cylinder 20 from behind after the fixing movement has been completed.

In both embodiments, the end face 59 of the lock cylinder 20 is provided with an armor plate 61 made of hardened steel. The armor plate 51 is intended to prevent unauthorized persons from picking the lock. For this reason, as especially FIG. 2 shows, the armor plate 61 has a narrow admission gap 62 for the key 19 shown in FIG. 1. As FIG. 2 shows, the armor plate 61 is rotatably supported in the cylinder housing 26, and when not in use, the admission gap 62 is closed by a spring-loaded lid 63. In addition, as FIG. 2 shows especially clearly, the armor plate 61 is intended largely to close the axial opening 43 in the cap 42.2.

LIST OF REFERENCE NUMBERS

10 door
11 inside of door 10
12 outside of door 10
13 interior of door 10
14 narrow side of door 10
15 exterior cladding of door 10
16 rear side of 15
17 visible side of 15
18 opening in 15
19 key assigned to 20
20 lock cylinder
21 parts of 20 at 12
23 flange on 20
24 hole in 23 for 32 (FIG. 2)
25 cylinder core (FIG. 2)
26 cylinder housing for 25 (FIG. 2)
27.1 support surface for 33 on 30 (FIG. 1)
27.2 support surface for 33 on 20 (FIG. 2)
28 axis of 20
29 connection between 20, 40, paddle (FIG. 1)
30 support
31 fastening device, bolt
32 shaft of 31
33 head of 31
34 hole in 30 for 32
35 assembly of 20, 30
36 arrow for insertion of 31 (FIG. 2)
37 rotational arrow indicating the screwing in of 31 (FIG. 2)
38 opening in 30 (FIGS. 1, 2)
39 axis of bolt 31 (FIG. 2)
40 lock (FIG. 1)
41 lock element of 40 (FIG. 1)
42.1 cap (FIG. 1)

42.2 cap (FIG. 2)
43 axial opening in 42.1
44 cap interior
45 threaded hole in 42.2 (FIG. 2)
46 angle on inclination between 39, 28 (FIG. 2)
47 inner end face of 48 (FIG. 2)
48 sidewall of 42.2 (FIG. 2)
49 point of application of 31 (FIGS. 1, 2)
50.1 coupling means (FIG. 1)
50.2 coupling means (FIG. 2)
51.1 first, moving coupling part on 42.1 (FIG. 1)
51.2 second, moving coupling part on 42.2 (FIG. 2)
52.1 second, stationary mating coupling part on 35 (FIG. 1)
52.2 second, stationary mating coupling part on 35 (FIG. 1)
53.1 shoulder on 51.1 (FIG. 1)
53.2 shoulder on 51.2 (FIG. 2)
54.1 coupling receptacle of 52.1 (FIG. 1)
54.2 coupling receptacle of 52.2 (FIG. 2)
55.1 mating shoulder on 56 (FIG. 1)
55.2 mating shoulder on 15 (FIG. 2)
56 additional radial flange (FIG. 2)
57 axial shoulder on 42.2 (FIG. 2)
58 mating shoulder for 57 on 20 and 26 (FIG. 2)
59 end face of 20 (FIGS. 1, 2)
60.1 insertion phase of a fixing movement of 42.1 or 51.1 (FIG. 1)
60.2 insertion phase of a fixing movement of 42.2 or 50.2 (FIG. 2)
61 armor plate
62 admission gap for 19 in 61 (FIG. 2)
63 spring-loaded lid (FIG. 2)

The invention claimed is:

1. A device for operating a lock (40) in a door (10) or hinged lid of a vehicle, with an assembly (35), which is preassembled from a support (30) and a lock cylinder (20) and can be mounted from the inside (11) of the door behind an exterior cladding (15) of the door, wherein the lock cylinder (20) includes a cylinder core (29) arranged in a cylinder housing (26), with openings (18, 38) in the exterior cladding (35) and in the support (30), which the lock cylinder (20) penetrates, with a cap (42.1; 42.2), which is seated on the outside (12) of the door and covers parts of the lock cylinder (20) located on the outside (12) of the door, where the cap (42.1; 42.2) has an axial opening (43) for a key (19) to be inserted in the lock cylinder (20) to operate the lock (40), and with a fastening device (31), which can be manipulated from the inside (11) of the door and joins the cap (42.1; 42.2) on the outside of the door with the support (30), where the fastening device (31) for the cap (42.1; 42.2) located on the outside (12) of the door, serves at the same time to mount the assembly (35) on the inside (11) of the door, wherein the fastening device is a threaded bolt (31) that consists of a shaft (32) and a head (33), where the bolt shaft (32) enters holes (24, 34, 35) that are aligned with one another in the support (30), in the lock cylinder (20) or the flange (23) of the lock cylinder (20), and in the cap (42.1; 42.2).

2. A device in accordance with claim 1, wherein the hole in the cap (42.1; 42.2) is the threaded hole (35) in which the bolt shaft (32) is anchored and that the bolt head (33) is accessible only from the inside (11) of the door for mounting and dismounting the cap (42.1; 42.2).

3. A device in accordance with claim 2, wherein the bolt shaft (32) in a mounted state is inclined to the axis (28) of the lock cylinder (20).

4. A device in accordance with claim 2, wherein the threaded hole (45) consists of a blind hole in the cap (42.1; 42.2), where the blind hole starts from the inner end face (47) of a sidewall (48) of the cap (42.1; 42.2), and where the sidewall (48) is inclined in essentially the same direction in which the blind threaded hole (45) extends.

5. A device in accordance with claim 2, wherein the head (33) of the tightened bolt (31) rests against a surface (support surface 27.1; 27.2) located on the support (30) or on the lock cylinder (20).

6. A device in accordance with claim 1, wherein the lock cylinder (20) has a projecting flange (23), on which the fastening device (31) acts.

7. A device in accordance with claim 1, wherein in the area of the base of the cap (42.1; 42.2) there is a radial shoulder (53.1; 53.2) and where, in the mounted state of the cap (42.1; 42.2), the shoulder (53.1; 53.2, 57) contacts a mating shoulder (55.1; 55.2, 58) from behind, which is located on the lock cylinder (20), on the support (30), and/or on the exterior cladding (15) of the door.

8. A device in accordance with claim 7, wherein the radial shoulder (53.1; 53.2, 57) is located on a side of the cap (42.1; 42.2) that is essentially diametrically opposite the point of application (49) of the fastening device (31) on the cap (42.1; 42.2).

9. A device in accordance with claim 7, wherein the cap (42.1; 42.2) is placed over the parts (21) of the lock cylinder (20) that are located on the visible side (17) of the exterior cladding (15) of the door by means of a fixing movement, where the fixing movement brings two coupling parts (51.1, 52.1; 51.2, 52.2) into engagement with each other, of which the moving coupling part (51.1; 51.2) is seated on the cap (42.1; 42.2) and has the radial shoulder (53.1; 53.2, 57).

10. A device in accordance with claim 9, wherein the fixing movement comprises two phases, where the first phase of the movement is an insertion movement (60.1; 60.2), which brings the coupling parts (51.1; 51.2) that are located on the cap side into a coupling receptacle (54.1; 54.2) of a mating coupling part (52.1; 52.2), where the mating coupling part (52.1; 52.2) is stationary during the fixing movement, and where the coupling receptacle (54.1; 54.2) in the mating coupling part (52.1; 52.2) has the mating shoulder (55.1; 55.2; 58).

11. A device in accordance with claim 7, wherein the mating shoulder (55.1) is formed by a radial flange (56) on the lock cylinder (20).

12. A device in accordance claim 7, wherein the mating shoulder (55.2) is formed by a section of the inner surface of the exterior cladding (15) of the door.

13. A device in accordance with claim 9, wherein the coupling receptacle (54.1; 54.2) of the stationary mating coupling part (52.1; 52.2) is located in the support (30).

14. A device in accordance with claim 9, wherein the coupling receptacle (54.2) of the stationary mating coupling part (52.2) is located in the lock cylinder (20).

15. A device in accordance claim 1, wherein an armor plate (61), which has only a narrow admission gap (62) for the key (19), is rotatably supported at the end face (59) of the lock cylinder (20), where the armor plate (61) closes the axial opening (43) in the cap (42.2).

* * * * *